United States Patent [19]

Ashmore et al.

[11] 4,108,696

[45] Aug. 22, 1978

[54] SOLID PROPELLANT HAVING INCORPORATED THEREIN A FERROCENE COMBUSTION CATALYST

[75] Inventors: Charles I. Ashmore, Owens Cross Roads; Charles S. Combs, Jr.; William D. Stephens, both of Huntsville, all of Ala.

[73] Assignee: Thiokol Corporation, Newtown, Pa.

[21] Appl. No.: 717,945

[22] Filed: Apr. 1, 1968

[51] Int. Cl.[2] ..... C06B 45/10

[52] U.S. Cl. ..... 149/19.2; 149/19.9; 149/44; 260/439 CY

[58] Field of Search ..... 149/19, 109, 19.2

[56] References Cited

U.S. PATENT DOCUMENTS

| | | | |
|---|---|---|---|
| 3,257,248 | 6/1966 | Short et al. | 149/19 |
| 3,305,523 | 2/1967 | Burnside | 149/19 X |
| 3,336,751 | 8/1967 | Rifkin et al. | 149/19 X |
| 3,341,495 | 9/1967 | Neuse | 149/109 X |

*Primary Examiner*—Leland A. Sebastian

*Attorney, Agent, or Firm*—Stanley A. Marcus; William R. Wright, Jr.

[57] ABSTRACT

A composite solid propellant wherein the burning rate thereof is materially increased by the addition thereto of a ferrocene combustion catalyst.

4 Claims, No Drawings

SOLID PROPELLANT HAVING INCORPORATED THEREIN A FERROCENE COMBUSTION CATALYST

BACKGROUND OF THE INVENTION

1. Field of the Invention

Composite solid propellants commonly consist of one or more solid inorganic or organic oxidizer materials uniformly dispersed in a matrix of fuel binder material. In addition such propellants often contain solid and/or liquid additives to enhance the ballistic and/or physical performance of the finished product. Composite solid propellants are commonly made by mixing the solid ingredients with the liquid matrix ingredient, which are solidified after a uniform dispersion of the solid materials has been obtained.

Due to increased operational requirements, one of the problems to which a solution had to be found, was to provide a composite solid propellant having increased burning rates. One method of achieving such increased burning rates was the addition to the composite solid propellant of a highly efficient catalytic combustion modifier, which may also be referred to as a combustion or burning rate catalyst, and this invention, therefore, relates to certain ferrocene compounds that may be added to the composite solid propellant to increase the burning rate thereof.

2. Description of the Prior Art

Ferrocene (dicyclopentadinyl iron) has been used as a catalytic combustion modifier in composite solid propellants for many years, despite many disadvantages which limit its use. It is a solid having only limited solubility in the commonly used fuel binder matrix materials. Thus, only a limited amount of ferrocene will be dissolved in the matrix, larger amounts being dispersed as solid particles. The microscopically uniform distribution necessary for the maximum catalytic effect is, therefore, impossible to obtain. A more significant disadvantage of ferrocene, however, is its physical instability in composite propellants. Although the causitive mechanism is not fully known, but may be associated with the compound's inherently high vapor pressure, ferrocene is gradually lost from composite solid propellants with which it is used. The loss is greatest at the elevated temperatures commonly encountered during the processing of propellants, but occurs even during storage of the finished propellant charges. Thus, the ferrocene content of a composite solid propellant charge does not remain constant, as desired, but gradually decreases as ferrocene is lost. Also, part of the ferrocene loss from the mass of the propellant charge is deposited on the exposed surfaces of the charge, such as the central perforation of a star-perforated charge.

Many unsuccessful attempts have been made to overcome or circumvent the undesirable loss of ferrocene from composite solid propellants. Excess ferrocene has been added during processing since this is when much of the loss occurs, so that the desired level will be obtained, at least temporarily. This procedure will not prevent the loss of catalysts during storage. Complex solid polymeric forms of ferrocene have been substituted for the simple compound, but have been found to be insoluble in the binders and inferior in respect to catalytic ability.

Liquid ferrocene compounds have been used with some success in overcoming the difficulties associated with the use of ferrocene itself. These liquid compounds generally consist of a ferrocene radical having a side chain attached to the ferrocene radical, which produces a liquid product with a higher molecular weight which is beneficial in decreasing the vapor pressure of the burning rate modifier. Thus, some improvements in volatility are realized by the use of these liquid compounds. However, the gains in decreasing the volatility of the ferrocene unit are realized only at the expense of the catalytic activity of the combustion modifier. In most instances, these liquid ferrocene compounds have decreased percentages of iron which results in a loss in efficiency of catalytic activity. In addition, the low molecular weight liquid ferrocene compounds have problems associated with freezing point, in that on long term storage of propellants at low temperatures, the liquid ferrocene compounds tend to crystallize, which results in a change in the physical properties of propellant under these conditions. This undesirable situation restricts the low temperature storage limits at which propellant can be maintained. In addition, many of the liquid ferrocene compounds have a pronounced tendency to bleed out of the propellant and migrate into the inert components in a solid propellant rocket motor. This problem causes a decrease in the physical properties of the inert components and may result in motor failure.

In order, therefore, to overcome the problems that existed, where the use of ferrocene compounds were concerned, the instant invention deals with and explains the manner of producing a solid propellant wherein the ferrocene compounds are utilized as a combustion catalyst to increase the burning rate of the solid propellant.

SUMMARY OF THE INVENTION

This invention, therefore, relates to a composite solid propellant that includes the addition of ferrocene compounds as burning rate catalyst to increase the burning rate of the solid propellant.

It is an object of the present invention, therefore, to provide a solid propellant that overcomes the disadvantages associated with the use of ferrocene as a catalytic combustion modifier, or problems associated with the use of low molecular weight liquid ferrocene derivatives are overcome.

It is a further object of this invention to provide an improved solid propellant that has more uniform distribution and enhanced efficiency of the catalytic combustion modifier so that the problems associated with volatility, migration of the combustion modifier, and changes in the physical properties of the solid propellant due to crystallization of the liquid ferrocene compound at low temperatures are overcome.

These objects being achieved without degradation of the physical properties of the solid propellant as a result of crystallization of the combustion modifier on storage at low temperatures.

These and other objectives of the present invention are achieved through the incorporation into composite solid propellants of organic iron compounds combining in a single molecule two or more ferrocenyl radicals with a straight or branched chain joining the ferrocenyl radicals.

The above and other objects and advantages will, it is believed, become more apparent to one skilled in the art from the following detailed description and discussion.

DESCRIPTION OF THE PREFERRED EMBODIMENTS

One of the most useful ferrocene compounds for achieving the objectives of this invention is 1, 3-diferocenyl-1-butene. This compound is prepared according to methods described in the literature (Stanley I. Goldburg, William D. Lobele and Thomas T. Tidwell, *Journal of Organic Chemistry,* 32, 4070 (1967), or by treating 1 - ferrocenylethanol with a dehydrating agent or a strong acid catalyst.

Another useful ferrocene compound for achieving the objectives of the instant invention is 1, 7-diferrocenylheptane which may be prepared by reaction of the diacid chloride of heptanedoic acid with ferrocene in the presence of anhydrous aluminum chloride, which yields 1, 7-diferrocenylheptance-1,7-dione. Reduction of 1,7-diferrocenylheptane-1,7-dione with zinc metal and hydrochloric acid subsequently gives 1,7-diferrocenylheptane in a good yield.

A solid propellant as covered by this invention is produced as set forth in the following example:

66.10% of parts by weight of ammonium perchlorate,
14.35% of parts by weight of a carboxy-modified polybutadiene or other carboxy-containing polymeric fuel binders,
12.00% of parts by weight of aluminum powder fuel,
0.55% of parts by weight of a curing agent, tris-(2-methylaziridinyl) phosphene oxide,
1.00% of parts by weight of dibutylcarbitol formal plasticizer,
6.00% of parts by weight of 1, 3-diferocenyl-1-butene combustion rate modifier;

are thoroughly mixed in a conventional mixer. After a homogeneous mixture has been obtained, the uncured propellant is placed in an oven at 135° F for 7 days. At this time a firm rubbery solid propellant with excellent physical and ballistic properties is obtained.

In the above group of ingredients, it is to be understood that 1, 7-diferrocenylheptane may be substituted in equal parts for the combustion rate modifier 1, 3-diferocenyl-1-butene without altering the steps of mixing, as previously described in the above set forth example.

It is also to be understood that the above two ferrocene compounds, as set forth, belong to a group wherein the structure thereof may be designated by the following symbols Fc-R-Fc, wherein Fc represents a ferrocene compound and R is selected from the group consisting of a alkyl, cycloalkyl, alkenyl and cycloalkenyl radicals, the carbon chain of which may be interrupted by oxygen, sulfur or nitrogen.

It is further pointed out that the ferrocene compound may be added to the group as set forth in the percentage of parts by weight of from 0.1 to 20%, depending on the burning rate that is desired to be obtained in the solid propellant.

It is to be understood, therefore, that while the present invention has been described by means of specific examples, it should not be limited thereto, for obvious variations and modifications may occur to those skilled in the art and such variations and modifications may be adhered to without departing from the spirit of the invention or the scope of the appended claims.

Having thus described the invention what is claimed as new and desired to be secured by letters Patent is:

1. A solid composite type propellant comprising in parts by weight of ammonium perchlorate, carboxy-modified polybutadiene, powdered aluminum, tris-(2-methylaziridinyl) phosphene oxide, a dibutylcarbitol formal plasticizer, to which is added as parts by weight in the percentage of 0.1 to 20 a ferrocene compound 1,3-diferrocenyl -1- butene which is of the structure Fc-R-Fc wherein Fc represents a ferrocene group and R is a radical selected from the group consisting of alkyl, cycloalkyl, alkenyl and cycloalkenyl radicals.

2. A solid composite type propellant comprising in parts by weight of ammonium perchlorate, carboxy-modified polybutadiene, powdered aluminum, tris-(2-methylaziridinyl) phosphene oxide, a dibutylcarbitol formal plasticizer, to which is added as parts by weight in the percentage of 0.1 to 20 a ferrocene compound 1,7-diferrocenylheptone which is of the structure Fc-R-Fc wherein Fc represents a ferrocene group and R is a radical selected from the group consisting of alkyl, cycloalkyl, alkenyl and cycloalkyl radicals.

3. A solid composite type propellant comprising in parts by weight of 66.10% ammonium perchlorate, 14.35% of a carboxy-modified polybutadiene, 12.00% of powdered aluminum, 0.55% of tris-(2-methylaziridinyl) phosphene oxide, 1.00% of a dibutylcarbitol formal plasticizer, to which is added as parts by weight in the percentage of 0.1 to 20 6.00% of 1, 3-diferocenyl-1-butene.

4. A solid composite type propellant as in claim 3, wherein 1, 7-diferrocenylheptane may be substituted for the 1, 3-diferrocenyl-1-butene.

* * * * *